United States Patent [19]

Denter et al.

[11] Patent Number: 4,573,387

[45] Date of Patent: Mar. 4, 1986

[54] KITCHEN UTENSIL FOR CUTTING OF FOOD

[75] Inventors: Ulrich Denter, Hambach; Rolf-Gunter Schülein, Singhofen, both of Fed. Rep. of Germany

[73] Assignee: Leifheit AG, Nassau, Fed. Rep. of Germany

[21] Appl. No.: 742,656

[22] Filed: Jun. 10, 1985

Related U.S. Application Data

[63] Continuation of Ser. No. 536,115, Sep. 26, 1983, abandoned.

[30] Foreign Application Priority Data

Sep. 27, 1982 [EP] European Pat. Off. ..... 82108918.2

[51] Int. Cl.[4] ..... B26D 1/02

[52] U.S. Cl. ..... 83/856; 74/110; 83/700; 83/870

[58] Field of Search ..... 30/293, 290, 296 R, 30/320; 99/539, 541, 537; 83/836–838, 870, 699, 700; 144/129, 129 R; 74/110 R; 16/223, DIG. 3

[56] References Cited

U.S. PATENT DOCUMENTS

| | | | |
|---|---|---|---|
| 66,402 | 7/1867 | Schwartz | 83/856 |
| 513,833 | 1/1894 | Sibbred et al. | 83/699 |
| 726,697 | 4/1903 | Kelley | 30/355 |
| 2,502,379 | 3/1930 | Hein et al. | 83/856 X |
| 2,872,957 | 2/1959 | Eschenburg | 144/129 X |

FOREIGN PATENT DOCUMENTS

| | | | |
|---|---|---|---|
| 816362 | 7/1969 | Canada | 16/225 |
| 1273759 | 7/1968 | Fed. Rep. of Germany | 30/278 |
| 14482 | 11/1884 | United Kingdom | 144/129 |

*Primary Examiner*—Douglas D. Watts

*Attorney, Agent, or Firm*—Frishauf, Holtz, Goodman & Woodward

[57] ABSTRACT

A kitchen appliance for cutting fruit and vegetables in slices, with an upper rigid guide plate (2) carrying a cutting knife (5) extending at an acute angle (4) to the side wall, and with a lower tongue-like guide plate (3) which is adjusted vertically by an adjusting rod (20) guided in the frame (1) and extending approximately parallel to the cutting knife (5), and which is connected to the frame (1) via a film hinge (13).

9 Claims, 7 Drawing Figures

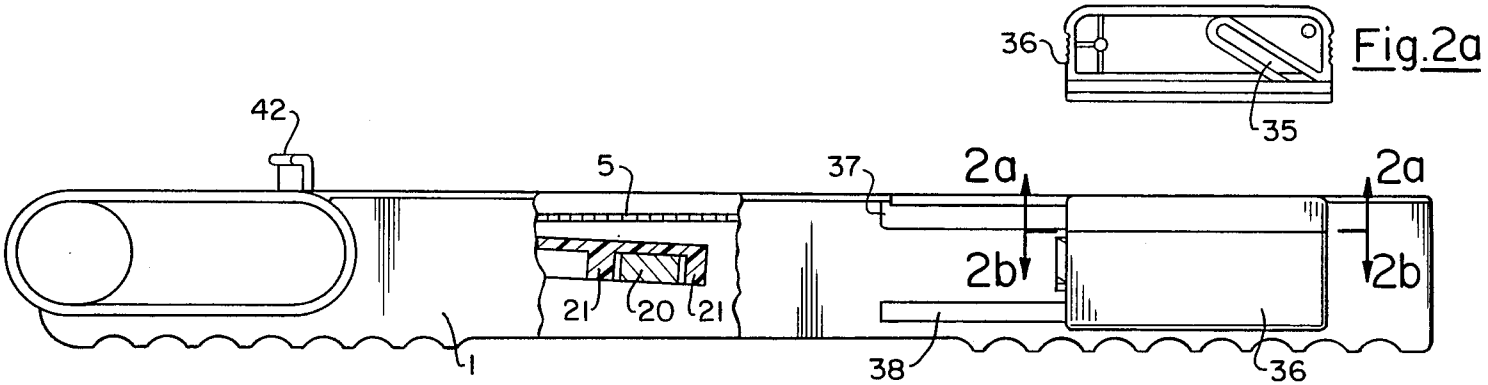
Fig.2a
Fig.2
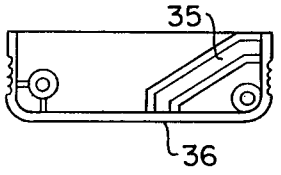
Fig.2b
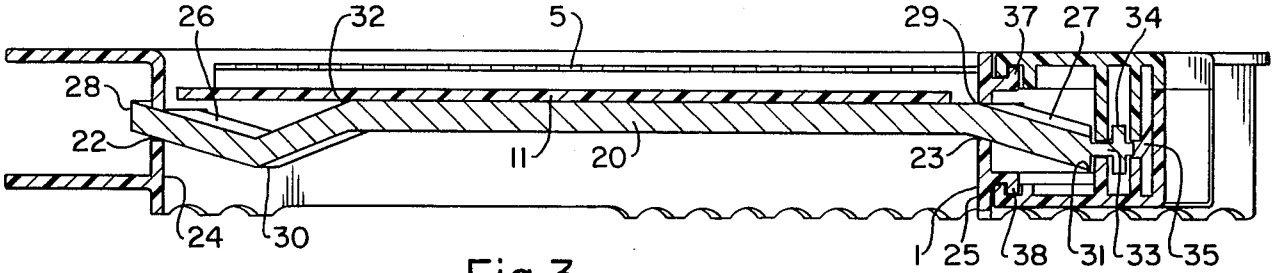
Fig.3

KITCHEN UTENSIL FOR CUTTING OF FOOD

This application is a continuation of application Ser. No. 536,115, filed Sept. 26, 1983, now abandoned.

The invention relates to a kitchen appliance for cutting fruit, vegetables and other foodstuffs.

In appliances of this type, the material to be cut into slices is guided on a lower guide plate and pressed against a cutting knife located on the upper guide plate. The cutting thickness is varied by adjusting the lower tongue-like guide plate. A kitchen appliance of this type is known from German Auslegeschrift 2,727,358. A disadvantage of this design is the vertical arrangement of the cutting knife in relation to the guide path of the material to be cut. As a result, it is not possible to cut delicate vegetables such as tomatoes.

The object of the invention is to provide a kitchen appliance for cutting fruit, vegetables and other foodstuffs, which cuts even delicate material, such as tomatoes, reliably, but at the same time allows the cutting thickness to be regulated precisely.

This object is achieved, according to the invention, by means of an appliance comprising an upper guide plate, at the end of which a cutting knife is located, and with a lower tongue-like guide plate vertically adjustable to regulate the cutting thickness, the guide plates being made in one piece with the frame surrounding them, wherein the end region, facing the cutting knife arranged at an angle less than or equal to 45° relative to a side wall of the frame, of the lower vertically moveable guide plate is supported by an adjusting rod held in perforations in the frame and displaceable in a longitudinal direction, the adjusting rod and/or the region of contact of the adjusting rod against the lower guide plate being profiled for the purpose of height adjustment. The relatively sharper inclination of the cutting knife allows a drawing cut to be made, so that even soft tough-skinned vegetables can be cut directly, the regulation of the cutting thickness acting at approximately the same angle relative to the frame as the cutting knife. Furthermore, the use of a guided adjusting rod makes it possible to ensure economical production allowing easy assembly.

The cutting edge of the knife is designed in the form of circular-segment pieces abutting one another at an acute angle.

The film hinge is formed in a way known per se by means of a contraction of the material thickness, the contraction being determined on the underside of the guide plate by a circular arc cut off by a chord, with a radius equal to and not less than double the material thickness, and the connecting chord of the two radius parts having a length equal to and not less than the material thickness.

The radius may also be approximately six times and the chord approximately double the material thickness, and the material thickness is approximately halved in the region of the chord.

The adjusting rod, is actuated by a slide which is guided on the frame and is connected frictionally to the adjusting rod. A deflecting guide for the adjusting rod is provided.

Thus, the special design of the cutting edge brings about an additional improvement of the cutting result. Because the lower guide plate is connected via a film hinge, it is possible to also make this guide plate very rigid. This ensures that it remains completely flat when the cutting thickness is adjusted. In contrast to this, in the adjustment of the cutting thickness according to German Auslegeschrift 2,727,358, the guide plate is curved uniformly. The disadvantage of this is that the cutting material no longer rests flat which is detrimental to the cutting result. Consequently, individual slices of boiled potatoes particularly tend to break.

The further design features of the film hinge serve to lengthen useful life. These measures ensure that bending takes place over a greater length, so that it is not necessary, as is normally customary in a film hinge, to use material of a higher grade. The conventional plastic material customarily used for making a vegetable grater is sufficient.

Because the film hinge is set far back into the region of the handle, an especially long guide distance on the lower guide plate is achieved.

Finally, the slide with its deflecting guide makes it possible to operate the cutting-thickness adjusting means in an especially simple way.

An exemplary embodiment of the invention is explained in more detail below with reference to the drawings in which:

FIG. 2 shows a side view in the direction II of FIG. 1, partially in section, FIGS. 2*a* and 2*b* showing the adjusting slide swung open, FIG. 3 shows a section along the line III—III according to FIG. 1.

Figure 1:
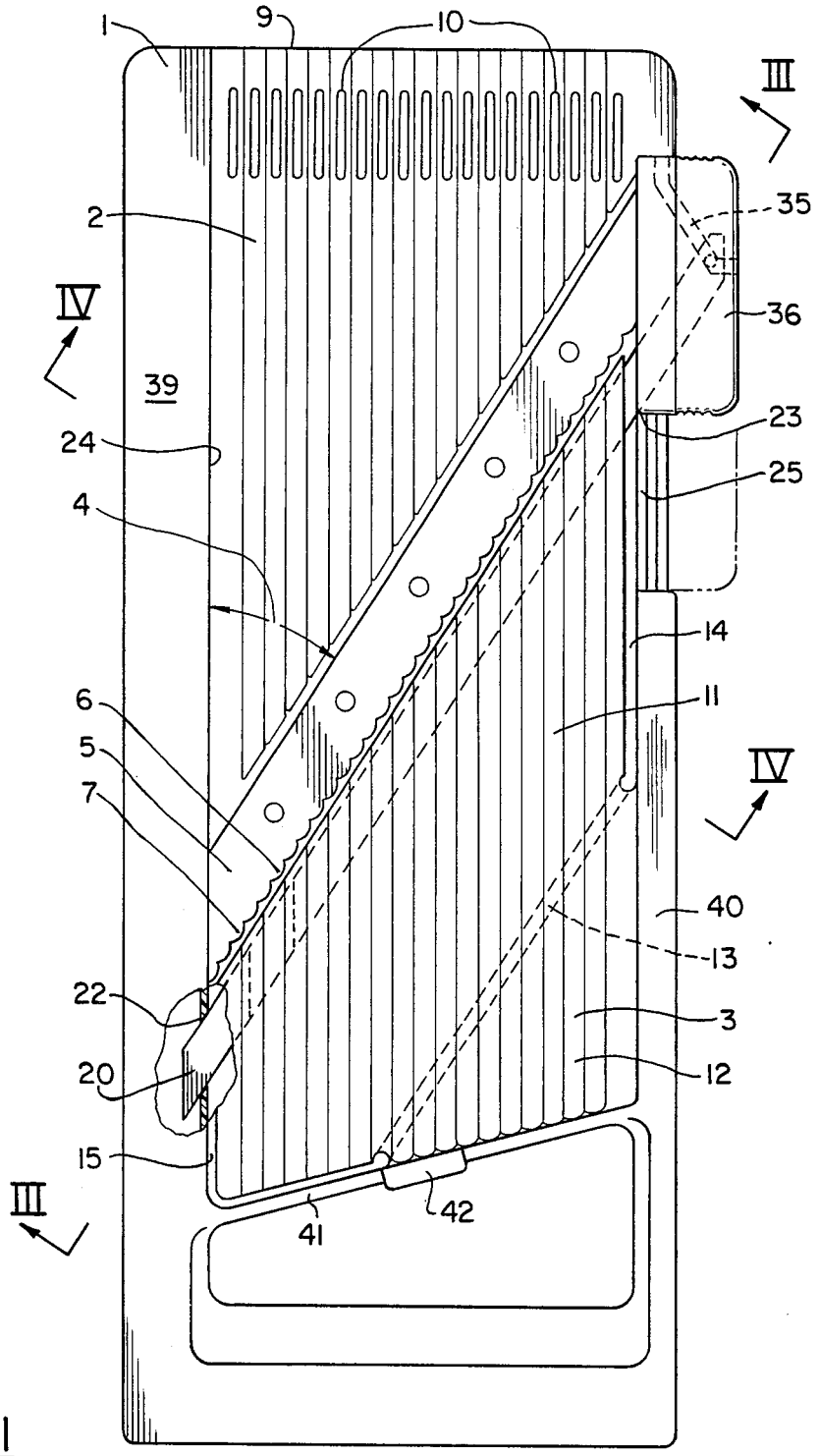
FIG. 1 shows a plan view of a kitchen appliance according to the invention.
Figure 4:
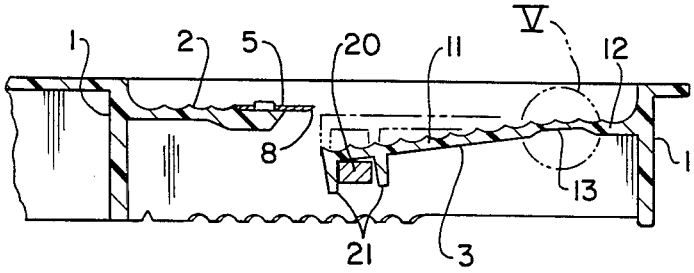
FIG. 4 shows a further section along the line IV—IV in FIG. 1.
Figure 5:
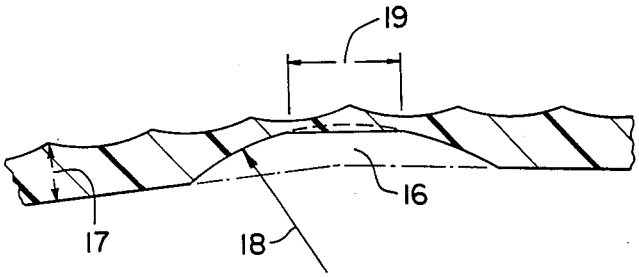
FIG. 5 shows the detail V in FIG. 4 enlarged.

A frame 1 is produced in one piece with an upper guide plate 2 and a lower guide plate 3. The upper guide plate 2 carries a cutting knife 5 at an angle 4 which is less than or equal to 45°, preferably 30°. The cutting edge 6 of the cutting knife 5 is designed in the form of circular-segment pieces 7 abutting one another at an acute angle. The ground surface 8 of the cutting edge 6 faces downwards. Liquid run-off slits 10 are provided at the end 9 of the upper guide plate 2.

The lower guide plate 3 is divided into an adjustable region 11 and a rigid region 12. The two regions 11 and 12 are separated by a film hinge 13. The film hinge 13 extends approximately parallel to the cutting knife 5 and is the only positive connection between the adjustable region 11 and the frame 1. The region 11 is separated from the frame 1 on both sides by a slit 14 and an L-shaped slit 15.

The film hinge 13 is formed by means of a contraction 16 of the material thickness 17. The transitions are each provided with a radius 18 and merge into a connecting chord 19 lying approximately parallel to the surface of the guide plate 2. In the example described, the material thickness is 2 mm, the radius 12 mm, the connecting chord 4 mm and the remaining material thickness in the connecting chord 1 mm.

An adjusting rod 20 is provided for adjusting the lower guide plate 3. It is located between two vertical webs 21 and is guided by perforations 22 and 23 in the side walls 24 and 25 of the frame 1. The adjusting rod 20 is angled at both ends and is provided respectively with adjusting slopes 26 and 27 lying parallel to one another. That is to say, point 28 is at the same level at point 29 and point 30 is at the same level as point 31. The region extending from the offset 32 to point 29 is plane and rests against the lower guide plate.

The adjusting slope 27 merges into a lug 33 with guide pins 34. By means of these guide pins 34, the adjusting rod 20 is guided in a deflecting guide 35 of the slide 36. The slide 36 is made in two parts and is clipped onto an upper and a lower guide web 37 and 38. These guide webs 37 and 38 extend parallel to the side wall 25 and are made in one piece with this. The position of the slide 36 shown in FIG. 1 produces the largest slice thickness, whilst the position of the slide shown by dot-and-dash lines produces thin slices.

The side walls 24 and 25 merge approximately at right angles into bearing surfaces 39 and 40 for a remnant slide not shown in any more detail. A retaining hook 42 is formed on the rear wall 41.

To ensure that the adjusting rod is accommodated completely in the thin-slice position, the bearing surface 39 is made relatively wide.

List of reference numerals

1: Frame
2: Upper guide plate
3: Lower guide plate
4: Angle
5: Cutting knife
6: Cutting edge
7: Circular-segment piece
8: Ground surface
9: End
10: Liquid run-off
11: Adjustable region
12: Rigid region
13: Film hinge
14: Slit
15: L-shaped slit
16: Contraction
17: Material thickness
18: Radius
19: Connecting chord
20: Adjusting rod
21: Web
(22)
Perforations
(23)
(24)
Side walls
(25)
(26)
Adjusting slopes
(27)
(28)
(29)
Points
(30)
(31)
32: Offset
33: Lug
34: Guide pin
35: Deflecting guide
36: Slide
(37)
Guide webs
(38)
(39)
Bearing surfaces
(40)
41: Rear wall
42: Retaining hook

I claim:

1. A kitchen appliance for cutting food comprising:

a frame having two oppositely situated side portions and an end portion interconnecting said side portions;

a first guide plate joined to said side portions and having an edge facing said end portion of said frame, said edge being directed at an angle of up to and including 45 degrees with one of said side portions of said frame;

cutting means extending along said edge;

a second guide plate having a first substantially rigid portion which is fixedly attached to said frame and a second substantially rigid portion positioned ajacent and spaced from said frame, said second portion having an edge region facing said edge of said first guide plate, said first portion and said second portion being hingedly joined together by hinge means, said hinge means extending substantially parallel to said cutting means; and adjusting means connected to said edge region of said second portion and mounted on said frame for displacement relative to said frame between a plurality of positions in which it supports said edge region along the length of said edge region at different transverse offsets from said cutting means to correspondingly vary the dimension of the food being cut by said cutting means, said adjusting means being coupled to said edge region of said second portion to maintain a substantially parallel relationship of said edge region relative to said cutting means over the complete length of said edge region.

2. The kitchen appliance as claimed in claim 1, wherein the cutting means is a knife having a cutting edge formed of circular-segment pieces of meeting one another at an acute angle.

3. The kitchen appliance as claimed in claim 2 wherein said cutting edge has a bottom surface which is directed at an angle away from said second guide plate.

4. The kitchen applicance as claimed in claim 1 wherein said hinge is formed at said second guide plate by a contraction having a form of a circular arc cut off at an intermediate portion thereof by a connecting chord, such that said arc has two radius portions connected together by said chord said arc having radius equal to and not less than double the thickness of second plate and the connecting chord of the two radius parts having a length equal and not less than said thickness.

5. The kitchen appliance as claimed in claim 1 wherein said hinge is formed in said second guide plate by a contraction having the form of a circular arc cut off at an intermediate portion thereof by a connecting chord, such that said arc has two radius portions connected together by said chord, said arc having a radius equal to and not less than six times the thickness of said second plate and the connecting chord of the two radius parts having a length equal to and not less than half said material thickness.

6. The kitchen appliance as claimed in claim 1 wherein said second portion includes web elements in which said adjusting means is received.

7. The kitchen appliance as claimed in claim 1 wherein said adjusting means includes an adjusting rod supporting said edge region and having spaced apart ends which are slidably engaged with said side portions of said frame, an actuating member frictionally connected to said adjusting rod and mounted on said frame for movement thereon, and a deflecting guide along which one of said spaced ends of said adjusting rod is movable.

8. The kitchen appliance as claimed in claim 7 wherein the other of said spaced ends of said adjusting rod has a slope which corresponds to an inclination of said deflecting guide.

9. A kitchen appliance for cutting food comprising:

a frame having two oppositely situated side portions and an end portion interconnecting said side portions;

a first guide plate joined to said side portions and having an edge facing said end portion of said frame, said edge being directed at an angle of up to and including 45 degrees with one of said side portions;

cutting means positioned along said edge;

a second guide plate having a first portion which is connected to said end portion and at least the other of said side portions, a second portion positioned adjacent and spaced from said frame by two slits and having an edge region facing said edge of said first guide plate, and a film hinge joining said first portion and said second portion and extending substantially parallel to said cutting means, one of said slits extending along a portion of one of said side portions to the point of intersection of said film hinge and said end portion and the other of said slits extending along said other of said side portions; and adjusting means including an elongated adjusting rod contacting said second portion and having spaced ends mounted on said side portions for displacement between a plurality of positions in which it supports said edge region at different transverse offsets from said cutting means for correspondingly varying the dimension of the food being cut by said cutting means.

* * * * *